US011795533B2

(12) United States Patent
Zhou et al.

(10) Patent No.: US 11,795,533 B2
(45) Date of Patent: Oct. 24, 2023

(54) HEAT-RESISTANT AND SOLUBLE MAGNESIUM ALLOY, PREPARATION METHOD AND USE THEREOF

(71) Applicants: QILU UNIVERSITY OF TECHNOLOGY, Shandong (CN); ADVANCED MATERIALS INSTITUTE, SHANDONG ACADEMY OF SCIENCES, Shandong (CN)

(72) Inventors: Jixue Zhou, Jinan (CN); Yunteng Liu, Jinan (CN); Dongqing Zhao, Jinan (CN); Baichang Ma, Jinan (CN); Meifang Wang, Jinan (CN); Peiliang Li, Jinan (CN); Cong Liu, Jinan (CN); Shouqiu Tang, Jinan (CN)

(73) Assignees: QILU UNIVERSITY OF TECHNOLOGY, Shandong (CN); ADVANCED MATERIALS INSTITUTE, SHANDONG ACADEMY OF SCIENCES, Shandong (CN)

( * ) Notice: Subject to any disclaimer, the term of this patent is extended or adjusted under 35 U.S.C. 154(b) by 276 days.

(21) Appl. No.: 15/931,104

(22) Filed: May 13, 2020

(65) Prior Publication Data

US 2020/0370156 A1 Nov. 26, 2020

(30) Foreign Application Priority Data

May 23, 2019 (CN) ..... 201910434832.7

(51) Int. Cl.
*C22F 1/06* (2006.01)
*C22C 23/00* (2006.01)
(Continued)

(52) U.S. Cl.
CPC ..... *C22F 1/06* (2013.01); *B22D 7/005* (2013.01); *C22C 23/00* (2013.01); *C22C 23/06* (2013.01)

(58) Field of Classification Search
None
See application file for complete search history.

(56) References Cited

U.S. PATENT DOCUMENTS

2009/0035171 A1* 2/2009 Kawamura ..... B21C 23/002 148/501
2011/0313527 A1* 12/2011 Witte ..... B22D 25/06 164/113
(Continued)

FOREIGN PATENT DOCUMENTS

CN 101092671 A 12/2007
CN 103350330 A * 10/2013
(Continued)

OTHER PUBLICATIONS

CN 110564996 machine translation (Year: 2019).*
(Continued)

*Primary Examiner* — Paul A Wartalowicz
*Assistant Examiner* — Stephani Hill
(74) *Attorney, Agent, or Firm* — Oliff PLC

(57) ABSTRACT

A heat-resistant and soluble magnesium alloy, and a preparation method having an elemental composition at the following atomic percentage: Lu 0.10% to 8.00%, Ce 0.001 to 0.05%, Al 0.10% to 0.60%, Ca 0.001% to 0.50%, Cu 0.01% to 1.00%, Ni 0.01% to 1.00%, impurity elements <0.30%, and the rest is Mg, and formed in magnesium alloys are high temperature phase of $Lu_5Mg_{24}$, $Mg_2Cu$, $Mg_2Ni$, $Mg_{12}Ce$, $Al_{11}Ce_3$ and $(Mg, Al)_2Ca$, and Long Period Stacking Ordered (LPSO) phases as Mg—Lu—Al and Mg—Ce—Al. The magnesium alloy has good mechanical performances at
(Continued)

150° C., and a dissolution rate of 30 to 100 mg·cm$^{-2}$h−1 in a 3% KCl solution at 93° C.

9 Claims, 3 Drawing Sheets

(51) Int. Cl.
*C22C 23/06* (2006.01)
*B22D 7/00* (2006.01)

(56) References Cited

U.S. PATENT DOCUMENTS

| | | | | |
|---|---|---|---|---|
| 2013/0041455 | A1* | 2/2013 | Gerold | A61L 31/022 623/1.15 |
| 2015/0086413 | A1* | 3/2015 | Wolverton | C22C 23/04 420/407 |
| 2016/0265091 | A1* | 9/2016 | Walton | E21B 41/00 |
| 2020/0063242 | A1* | 2/2020 | Valls | C22C 23/00 |

FOREIGN PATENT DOCUMENTS

| | | | | | |
|---|---|---|---|---|---|
| CN | 104004950 | A | * | 8/2014 | |
| CN | 104073702 | A | | 10/2014 | |
| CN | 105039817 | A | | 11/2015 | |
| CN | 106636821 | A | | 5/2017 | |
| CN | 105018812 | B | | 11/2017 | |
| CN | 107574325 | A | | 1/2018 | |
| CN | 107119220 | B | | 9/2018 | |
| CN | 108588521 | A | * | 9/2018 | |
| CN | 109680195 | A | * | 4/2019 | A61L 27/047 |
| CN | 110564996 | A | * | 12/2019 | C22C 1/03 |
| JP | 2008106337 | A | | 5/2008 | |
| JP | 2017160495 | A | | 9/2017 | |
| SU | 492581 | A | * | 6/1978 | |
| WO | WO-2011117630 | A1 | * | 9/2011 | C22C 23/06 |

OTHER PUBLICATIONS

CN 103350330 machine translation (Year: 2013).*
CN 104004950 machine translation (Year: 2014).*
SU 492581 machine translation (Year: 1978).*
CN 109680195 machine translation (Year: 2019).*
CN 108588521 machine translation (Year: 2018).*
Office Action issued in Chinese Patent Application No. 201910434832.7.
Zhang Huaibo, "Experimental Research on Mechanical and Solubility Property of the Soluble Magnesium Alloy"; Thesis; Dalian Maritime University; 2017; pp. 1-53.

* cited by examiner

HEAT-RESISTANT AND SOLUBLE MAGNESIUM ALLOY, PREPARATION METHOD AND USE THEREOF

FIELD OF THE INVENTION

The invention pertains to a technical field of metallic material preparation, and particularly relates to a heat-resistant and soluble magnesium alloy, and a preparation method and use thereof.

BACKGROUND OF THE INVENTION

The disclosure of the information in this "Background of the Invention" section is only for the purpose of increasing the understanding of the general background of the invention and is not necessarily to be taken as an acknowledgement or any form of suggestion that this information constitutes prior art that is already well known to those of ordinary skill in the art.

At present, a pressure fracturing technology is mostly used in shale oil and gas exploit and production, and the components commonly used include: a bridge plug and a fracturing ball. These components are both structural and functional, and they can fulfill functions of support or pressure control during pressure fracturing production; and they need to be dissolved naturally in the groundwater environment after use. In general, the relevant components are made of soluble metal materials, which avoids a high-cost and low-efficiency manual removing process, and eliminates the possibility of pipeline blockage. Dissolvable metal materials include: an aluminum alloy and a magnesium alloy. The aluminum alloy can be significantly passivated in alkaline solution environment, which has limited its wider application to some extent. In order to meet the needs of exploit and production conditions in different oil and gas fields, researchers prepared a variety of soluble magnesium alloys by alloying, improving the forming process and heat treatment. Patent 201611015708.X "Intelligent degradation magnesium alloy material and preparing method and application thereof" discloses a magnesium alloy containing Al, Zn, Sn, Ca, Gd, Dy, Y, Nd, La, Ce, Sr, Er, Zr, Ni, Ga, In, Fe, Cu and other elements, which was used through melting, and specific extrusion casting process to obtain corresponding products. The alloy product has a tensile strength ≥200 to 250 MPa, an elongation ≥4 to 5%, and a compressive strength ≥260 to 280 MPa. It is mainly used as downhole tools for petroleum and shale gas mining. Master degree's thesis "Experimental Research on the Mechanical Performances and Solubility of Soluble Magnesium Alloy" (Zhang Huaibo, Dalian Maritime University, 2017) provides a Mg—Al—Zn magnesium alloy, which proposes when the Al content is 6.5% wt, the obtained alloy has the best compressive strength and solubility performances, and its compressive strength can reach as high as 360 to 375 MPa. However, most of the published soluble magnesium alloy patents do not present a mechanical performance at high temperature, while some oil and gas resources are mined at a relatively high temperature condition.

Patent CN105018812B"Heat-resistant magnesium alloy and its preparation method" discloses a Mg—Al—Sn—Sm alloy. The alloy has a tensile strength ≥206 MPa and a Yield Strength ≥162 MPa at 200° C. Patent CN107574325A "Preparation method of Mg—Ce—Mn—Sc heat-resistant magnesium alloy" discloses that an alloy has good room temperature/a high temperature tensile performances and creep resistance at a high temperature of 300° C. Patent CN107119220B discloses a Mg—Sm—Al—Sn—Si—Mn—Ag—Zn—Ca heat resistant alloy, which also has excellent a high temperature tensile strength and creep resistance.

The inventors found that it can be found from the prior at that although the current heat-resistant magnesium alloy has good high-temperature mechanical performances, but it does not have solubility performances. The magnesium alloys in the prior art cannot be able to obtain good high-temperature mechanics and solubility performances at the same time.

SUMMARY OF THE INVENTION

In view of the problems mentioned above in the prior art, an object of the present invention is to provide a heat-resistant and soluble magnesium alloy and a preparation method thereof.

In order to solve the above technical problems, the present invention provides the following technical solution:

In one aspect, it is provided a heat-resistant and soluble magnesium alloy having an elemental composition at the following atomic percentage: Lu 0.10% to 8.00%, Ce 0.001 to 0.05%, Al 0.10% to 0.60%, Ca 0.001% to 0.50%, Cu 0.01% to 1.00%, Ni 0.01% to 1.00%, impurity elements <0.30%, and the rest is Mg. Formed in magnesium alloys are high temperature phase of $Lu_5Mg_{24}$, $Mg_2Cu$, $Mg_2Ni$, $Mg_{12}Ce$, $Al_{11}Ce_3$ and $(Mg, Al)_2Ca$, and Long Period Stacking Ordered (LPSO) phases as Mg—Lu—Al and Mg—Ce—Al.

In the present invention, the impurity element refers to an unavoidable impurity element brought in from the raw materials during the preparation of the alloy, that is, a metal or non-metal elements that exist in the metal but is not intentionally added or reserved.

By adjusting, in the magnesium alloy, the content of the main element Lu and the multiple alloying of Ce, Al, Ca, Cu, and Ni, a heat-resistant and soluble magnesium alloy is obtained.

Lu element has a large solid solubility in magnesium, and therefore has a solid solution strengthening effect. The addition of a proper amount of Lu element can significantly reduce the grain size of the ingot and improve the elongation of the alloy under a high temperature environment. In addition, the solid solubility of Lu element decreases significantly with temperature decrease, and a dispersed high melting point $Lu_5Mg_{24}$ phase can be obtained by a subsequent aging treatment, therefore its high temperature strength and creep resistance are improved. The grain size has a great impact on the mechanical performances of the material: under high temperature use, in order to improve the plasticity and toughness of the metal, fine grains are generally required; while in order to improve the creep resistance and strength, large grains are generally required. Therefore, the alloy of the present invention can obtain a material with high elongation or high strength at a high temperature, and achieve control to grain size in combination.

Ce, Al, and Ca also have a remarkable effect of refining grains, and Ce, Mg, and Al can form high temperature phases of $Mg_{12}Ce$, $Al_{11}Ce_3$ and $(Mg, Al)_2Ca$, respectively. Al can also improve a fluidity of the alloy in a casting process and reduce a casting defect.

A two-atom pair formed from Mg, Lu/Ce, and Al has negative mixing enthalpy, and the order of the atomic radius is: Lu/Ce>Mg>Al, so the alloy of the present invention can be subjected to a casting and subsequent aging treatment to obtain a LPSO phase i.e. Mg—Lu—Al phases and Mg—Ce—Al phases, which further improve the performances of the alloy.

Together with magnesium, Cu and Ni can form high-melting intermetallic compounds ($Mg_2Cu$ and $Mg_2Ni$) distributed at the grain boundaries and within the grains boundaries. By adjusting the morphology, size, and ratio of the two compounds, a good solubility performance can be obtained.

In some embodiments, it is provided a heat-resistant and soluble magnesium alloy, having an elemental composition at the following atomic percentage: Lu 0.10% to 4.00%, Ce 0.001 to 0.04%, Al 0.20% to 0.50%, Ca 0.10% to 0.40%, Cu 0.10% to 0.50%, Ni 0.10% to 0.50%, impurity elements <0.30%, and the rest is Mg. Formed in magnesium alloys are high temperature phase of $Lu_5Mg_{24}$, $Mg_2Cu$, $Mg_2Ni$, $Mg_{12}Ce$, $Al_{11}Ce_3$ and $(Mg, Al)_2Ca$, and LPSO phases as Mg—Lu—Al and Mg—Ce—Al.

In some embodiments, it is provided a heat-resistant and soluble magnesium alloy, having an elemental composition at the following atomic percentage: Lu 0.50%, Ce 0.02%, Al 0.20%, Ca 0.10%, Cu 0.20%, Ni 0.10%, impurity elements <0.20%, and the rest is Mg. Formed in magnesium alloys are high temperature phase of $Lu_5Mg_{24}$, $Mg_2Cu$, $Mg_2Ni$, $Mg_{12}Ce$, $Al_{11}Ce_3$ and $(Mg, Al)_2Ca$, and LPSO phases as Mg—Lu—Al and Mg—Ce—Al.

In some embodiments, it is provided a heat-resistant and soluble magnesium alloy, having an elemental composition at the following atomic percentage: Lu 4.0%, Ce 0.04%, Al 0.50%, Ca 0.50%, Cu 0.40%, Ni 0.20%, impurity elements <0.20%, and the rest is Mg. Formed in magnesium alloys are high temperature phase of $Lu_5Mg_{24}$, $Mg_2Cu$, $Mg_2Ni$, $Mg_{12}Ce$, $Al_{11}Ce_3$ and $(Mg, Al)_2Ca$, and LPSO phases as Mg—Lu—Al and Mg—Ce—Al.

In second aspect, a preparation method for a heat-resistant and soluble magnesium alloy, comprising:

the various raw materials are mixed in proportion; the obtained mixture is melted and refined to obtain a melt; the melt is casted to obtain an ingot; the ingot is homogenized to obtain a billet; the billet is plastically processed; the obtained shaped part is subjected to an aging strengthening treatment so as to obtain the magnesium alloy.

In some embodiments, the raw material is a pure magnesium ingot, a pure aluminum ingot, a Mg—Lu master alloy, a Mg—Ce master alloy, a Mg—Ca master alloy, a Mg—Cu master alloy and a Mg—Ni master alloy; preferably, the raw material is a pure magnesium ingot, a pure aluminum ingot, a Mg-30 wt. % Lu master alloy, a Mg-30 wt. % Ce master alloy, a Mg-30 wt. % Ca master alloy, a Mg-30 wt. % Cu master alloy and a Mg-25 wt. % Ni master alloy.

In some embodiments, a temperature for the melting is 720° C.-760° C. In some embodiments, a duration for the melting is 40 to 60 min, preferable 50 to 60 min, more preferable 60 min.

In some embodiments, a duration for the refining is 20 min to 40 min, preferable 20 min.

In some embodiments, after the refining the temperature is raised to 780° C. to 800° C., and the system is allowed to stand still; preferably, after the refining the temperature is raised to 760° C.; preferably, a duration for the still stand 30 to 40 min, more preferable 40 min.

In some embodiments, during the melting process, the melt is stirred for a duration of 5 to 20 min, preferably, the duration of stirring is 10 to 20 min, more preferably the duration of stirring is 10 min.

In some embodiments, in the refining process, a refining agent can be added or an inert protective gas can be introduced in a refining furnace; preferably, the inert protective gas is $CO_2$+$SF_6$ mixed gas, argon, nitrogen or helium; more preferably the volume ratio of $CO_2$ and $SF_6$ in the $CO_2$+$SF_6$ mixed gas is 200 to 400:1.

The alloy will inevitably absorb and carry gases, and generate inclusions during the melting process, this will reduce the purity of the alloy. The gas and inclusions generated can be removed through the refining to improve the purity and quality of the alloy. The temperature raising and standing still after refining allow the impurities to float up or sink down quickly, further improving the purity of the alloy.

In some embodiments, a temperature for the casting is 680 to 700° C.; preferable 680° C.

Lowering the casting temperature can reduce the degree of metal shrinkage, reduce the occurrence of defects such as shrinkage hole, shrinkage porosity and coarse grains, and then further improve the performance of the material.

In some embodiments, the solid solution treatment comprises steps that the ingot is sequentially heated, maintained at the temperature and cooled.

In some further embodiments, the ingot is heated to a temperature of 480 to 540° C.; preferable 480° C.

In some further embodiments, the ingot is maintained at the temperature for 2 to 24 h; preferable 4 to 16 h; more preferable 10 h.

In some further embodiments, an air cooling is employed as the cooling manner.

By adopting a high temperature solid solution treatment process, on one hand, the high-temperature phase containing rare earth can be solid-dissolved into the magnesium matrix as soon as possible, which facilitates subsequent plastic processing after homogenization; on the other hand, the solid solution time can be adjusted to promote the rapid and uniform growth of grains, which lays a foundation for obtaining a heat-resistant equiaxed grains of different sizes.

In some embodiments, the plastic process is an extrusion, a rolling or a forging.

In some further embodiments, an extrusion temperature of the extrusion is 400 to 450° C.

In some further embodiments, an extrusion ratio is 4:1 to 60:1; preferable 8:1 to 20:1.

In some further embodiments, an extrusion speed is 0.1 to 5.0m/min; preferable 0.5 to 1.0 m/min.

In some further embodiments, an extrusion temperature of the extrusion is 450° C.

In some further embodiments, a temperature of the finish rolling is 380 to 400° C.

In some further embodiments, a reduction in pass is 5% to 15%.

In some further embodiments, a total reduction is 50% to 90%.

In some further embodiments, a rolling speed is 0.5 to 10m/min.

When forming by processing at a high temperature and a low deformation speed, the dynamic recrystallization has a mechanism mainly through grain boundaries bulging nucleation, which can promote the occurrence of a steady state dynamic recrystallization, obtain a higher recrystallization volume fraction and a uniform equiaxed crystals, and optimize the microstructure structure.

In some embodiments, a temperature of the aging strengthening is 90 to 480° C.; preferable 160 to 200° C.

In some embodiments, a duration aging of the aging strengthening is 1 to 96 h; preferable 24 to 96 h.

Use of the above defined magnesium alloy in manufacture of a bridge plug and a fracturing ball.

The magnesium alloy prepared by the present invention has a heat resistance and a solubility, such that a bridge plug or a fracturing ball has a better application performance.

Beneficial effects of the present invention:

(1) With adjusting the content of the main element Lu and the multiple alloying of Ce, Al, Ca, Cu, and Ni, in combination with a homogenization, a plastic forming and an aging process, the present invention can prepare a heat-resistant and soluble magnesium alloy with different performances.

(2) With adding a proper amount of Lu element, the present invention can significantly reduce the grain size of the ingot and improve the elongation of the alloy under a high temperature environment. A dispersed high melting point $Lu_5Mg_{24}$ phase can be obtained by an aging treatment, and the high temperature strength and creep resistance of the alloy are improved.

(3) With adding an appropriate amount of Ce, Al, and Ca into the alloy, the invention can refine the grains of the ingot, reduce the segregation of Cu and Ni in the ingot, and further form a fine dispersed high melting point phase, $Mg_2Cu$ and $Mg_2Ni$, inside the grain and on the grain boundaries, so as to achieve the goal of uniform dissolution. This can also promote the formation of high temperature phases of $Mg_{12}Ce$, $Al_{11}Ce_3$ and $(Mg, Al)_2Ca$, and improve the high temperature mechanical performances. Al can improve the fluidity of the melt and reduce casting defects.

(4) In the present invention Lu, Ce, Ca elements are added, and these elements can form a dense protective film with the magnesium melt during the melting process, reducing the occurrence of oxidative combustion, thereby simplifying the process. The addition of Ce and Ca elements can weaken a magnesium alloy texture, reducing an anisotropy of the material.

(5) The invention adopts a short-term or long-term solid solution treatment to obtain a fine or large-size equiaxed grains by processing under high temperature and low deformation rate conditions, and then in combination with a suitable aging treatment process, it is precipitated a LPSO phase-Mg—Lu—Al and Mg—Ce—Al phases, and prepare a heat-resistant and high-elongation soluble magnesium alloy or a heat-resistant and high-strength soluble magnesium alloy.

(6) The heat-resistant and soluble magnesium alloy of the present invention improves the heat-resistant performance and solubility of the material through micro-alloying of various elements, and has a good application prospect in the fields of shale oil and gas exploit and production and the like.

(7) The heat-resistant and soluble magnesium alloy prepared by the invention has good mechanical performances at 150° C.: its tensile yield strength at 150° C. exceeds 90% of its tensile yield strength at room temperature, and its elongation at 150° C. exceeds its elongation at room temperature. The dissolution rate in a 3% KCl solution at 93° C. is 30-100 $mg \cdot cm^{-2}h^{-1}$.

BRIEF DESCRIPTION OF THE DRAWINGS

The accompanying drawings, which constitute a part of the present invention, are used to provide further understanding of the present application. The exemplary examples of the present invention and the descriptions thereof are used to explain the present invention, and do not constitute an improper limitation on the present invention.

DETAILED DESCRIPTION OF THE EMBODIMENTS

Figure 1:
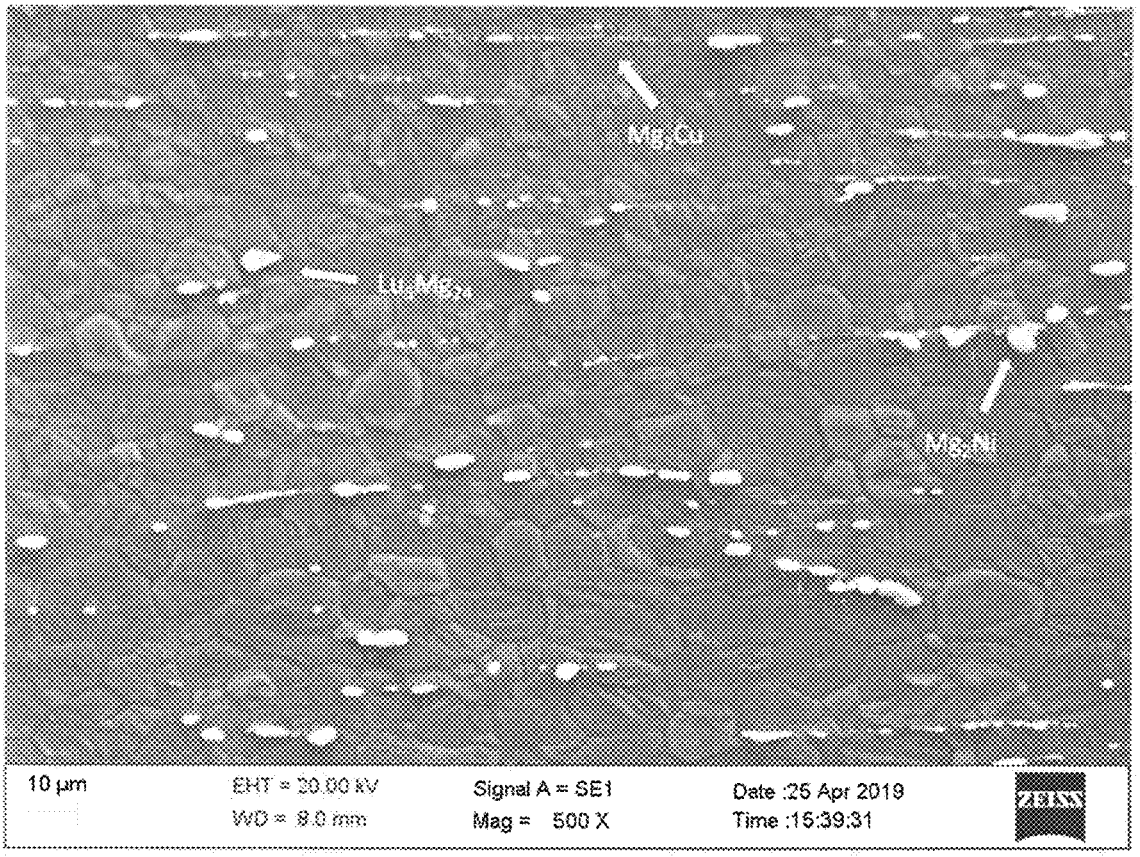
FIG. 1 is a SEM image of microstructure of the magnesium alloy from Example 1.

It should be noted that the following detailed descriptions are all exemplary and are intended to provide further explanation of the present invention. Unless defined otherwise, all technical and scientific terms used herein have the same meaning as commonly understood by one of ordinary skill in the art to which this invention belongs.

It should be noted that the terminology used herein is only for describing a specific embodiment, and is not intended to limit the exemplary embodiments according to the present application. As used herein, the singular forms are intended to include the plural forms as well, unless the context clearly indicates otherwise, and it should also be understood that when the terms "including" and/or "including" are used in this specification, they indicate the presence of features, steps, operations, devices, components, and/or combinations thereof. It is further described the present invention below in conjunction with Examples.

Example 1

The heat-resistant and soluble magnesium alloy described in this Example is a material having a high elongation and a slow dissolving rate, which has an elemental composition at the following atomic percentage: Lu 0.40%, Ce 0.04%, Al 0.20%, Ca 0.01%, Cu 0.10%, Ni 0.05%, impurity elements <0.30%, and the rest is Mg.

The heat-resistant and soluble alloy in this Example is prepared by a method comprising steps of:

(1) the raw materials were weighted according to the above amount ratio, the raw materials used were a pure magnesium ingot, a pure aluminum ingot, Mg—Lu master alloy, a Mg—Ce master alloy, a Mg—Ca master alloy, a Mg—Cu master alloy, a Mg—Ni master alloy.

(2) under protection of a mixed gas of $CO_2$ and $SF_6$ at a volume ratio of 200:1, the raw materials were melt at 720° C., maintained at the temperature for 60 min, stirred for 10 min, and refined for 20 min, after the refining the temperature is raised to 780° C., allowed to stand still for 40 min, and cast into a semi-continuous ingot at 680° C.

(3) the above ingot was subjected to a homogenization, at 480° C. for 4 h; cooled by an air cooling; then cut into corresponding billet, which was then peeled.

(4) the billet was extruded into a bar through an extruder under the conditions of an extrusion temperature of 400° C., an extrusion ratio of 8, and an extrusion speed of 1 m/min.

(5) the above bar was subjected to an aging strengthening treatment at an aging strengthening treatment temperature of 170° C. for 24 hours, and the strength was further improved to obtain the heat-resistant and soluble alloy having a high elongation in this Example.

Figure 2:
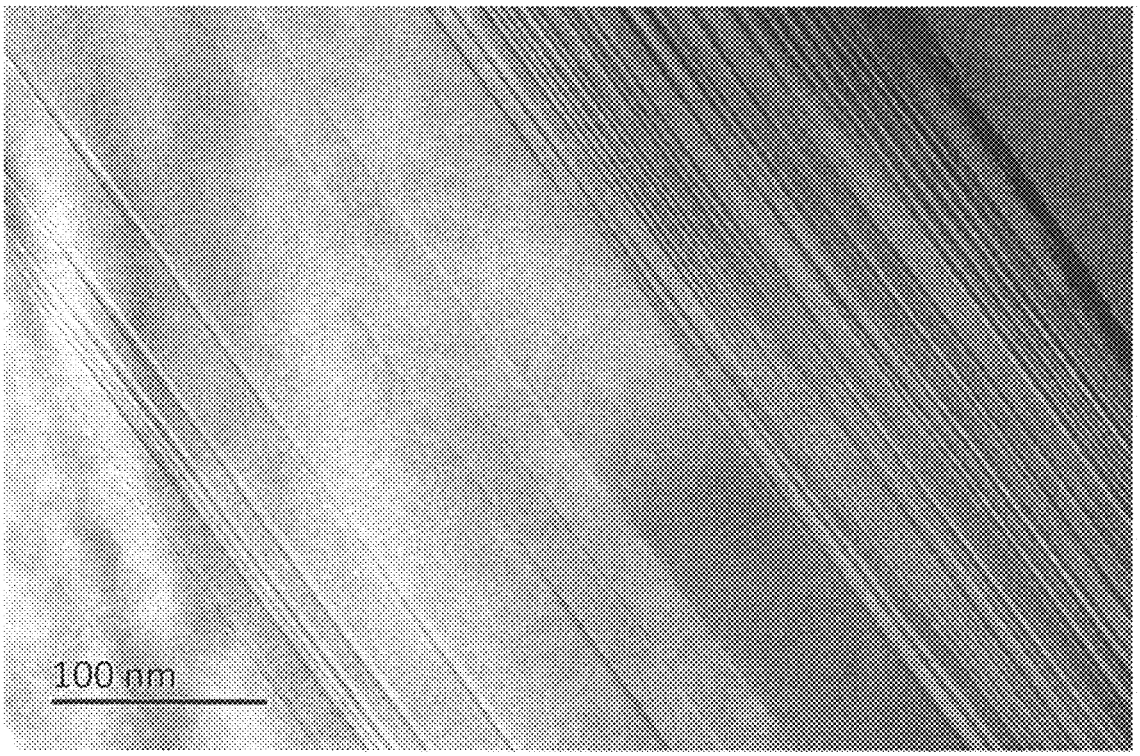
FIGS. 2(*a*) and 2(*b*) are TEM images of microstructure of the magnesium alloy from Example 1, and the LPSO phases are: (a) Mg—Lu—Al and (b) Mg—Ce—Al phases.
Figure 2:
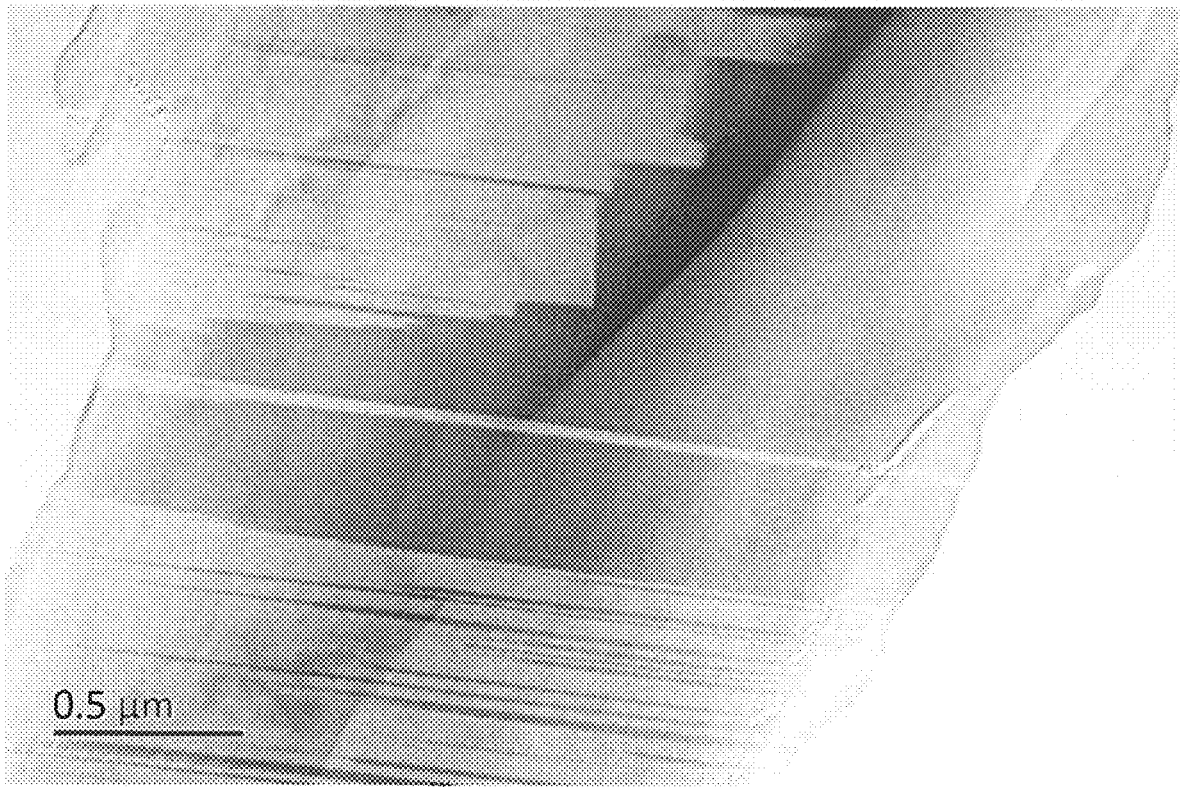

It can be seen from FIG. 1 that the microstructure of the magnesium alloy contains high-temperature phases of $Lu_5Mg_{24}$, $Mg_2Cu$, $Mg_2Ni$. From the TEM image of FIG. 2, it can be found that a LPSO phase, Mg—Lu—Al and Mg—Ce—Al phases, was formed in the microstructure of the magnesium alloy.

Example 2

The heat-resistant and soluble magnesium alloy described in this Example is a material having a high elongation and a slow dissolving rate, which has an elemental composition at the following atomic percentage: Lu 0.10%, Ce 0.001%, Al 0.10%, Ca 0.001%, Cu 0.01%, Ni 0.01%, impurity elements <0.30%, and the rest is Mg.

The heat-resistant and soluble alloy in this Example is prepared by a method comprising steps of:

(1) the raw materials were weighted according to the above amount ratio, the raw materials used were a pure magnesium ingot, a pure aluminum ingot, Mg—Lu master alloy, a Mg—Ce master alloy, a Mg—Ca master alloy, a Mg—Cu master alloy, a Mg—Ni master alloy.

(2) under protection of a mixed gas of $CO_2$ and $SF_6$ at a volume ratio of 200:1, the raw materials were melt at 720° C., maintained at the temperature for 50 min, stirred for 10 min, and refined for 30 min, after the refining the temperature is raised to 780° C., allowed to stand still for 30 min, and cast into a semi-continuous ingot at 680° C.

(3) the above ingot was subjected to a homogenization, at 480° C. for 2 h; cooled by an air cooling; then cut into corresponding billet, which was then peeled.

(4) the above billet was extruded into a bar through an extruder under the conditions of an extrusion temperature of 400° C., an extrusion ratio of 20, and an extrusion speed of 0.5 m/min.

(5) the above bar was subjected to an aging strengthening treatment at an aging strengthening treatment temperature of 160° C. for 36 hours, and the strength was further improved to obtain the heat-resistant and soluble alloy having a high elongation in this Example.

Example 3

The heat-resistant and soluble magnesium alloy described in this Example is a material having a high-strength and a fast dissolving rate, which has an elemental composition at the following atomic percentage: Lu 8.00%, Ce 0.05%, Al 0.60%, Ca 0.50%, Cu 1.00%, Ni 1.00%, impurity elements <0.30%, and the rest is Mg.

The heat-resistant and soluble alloy in this Example is prepared by a method comprising steps of:

(1) The raw materials were weighted according to the above amount ratio, the raw materials used were a pure magnesium ingot, a pure aluminum ingot, Mg—Lu master alloy, a Mg—Ce master alloy, a Mg—Ca master alloy, a Mg—Cu master alloy, a Mg—Ni master alloy.

(2) Under protection of a mixed gas of $CO_2$ and $SF_6$ at a volume ratio of 400:1, the raw materials were melt at 760° C., maintained at the temperature for 60 min, stirred for 20 min, and refined for 20 min, after the refining the temperature is raised to 800° C., allowed to stand still for 30 min, and cast into a semi-continuous ingot at 700° C.

(3) The above ingot was subjected to a homogenization, at 540° C. for 16 h; cooled by an air cooling; then cut into corresponding billet, which was then peeled.

(4) The above billet was extruded into a bar through an extruder under the conditions of an extrusion temperature of 450° C., an extrusion ratio of 8, and an extrusion speed of 0.5 m/min.

(5) The above bar was subjected to an aging strengthening treatment at an aging strengthening treatment temperature of 200° C. for 48 hours, and the strength was further improved to obtain the heat-resistant and soluble alloy having a high strength in this Example.

Example 4

The heat-resistant and soluble magnesium alloy described in this Example is a material having a high-strength and a fast dissolving rate, which has an elemental composition at the following atomic percentage: Lu 4.00%, Ce 0.03%, Al 0.20%, Ca 0.20%, Cu 0.80%, Ni 0.80%, impurity elements <0.30%, and the rest is Mg.

The heat-resistant and soluble alloy in this Example is prepared by a method comprising steps of:

(1) The raw materials were weighted according to the above amount ratio, the raw materials used were a pure magnesium ingot, a pure aluminum ingot, Mg—Lu master alloy, a Mg—Ce master alloy, a Mg—Ca master alloy, a Mg—Cu master alloy, a Mg—Ni master alloy.

(2) Under protection of a mixed gas of $CO_2$ and $SF_6$ at a volume ratio of 400:1, the raw materials were melt at 760° C., maintained at the temperature for 50 min, stirred for 15 min, and refined for 30 min, after the refining the temperature is raised to 800° C., allowed to stand still for 35 min, and cast into a semi-continuous ingot at 700° C.

(3) The above ingot was subjected to a homogenization, at 540° C. for 12 h; cooled by an air cooling; then cut into corresponding billet, which was then peeled.

(4) The above billet was extruded into a bar through an extruder under the conditions of an extrusion temperature of 450° C., an extrusion ratio of 10, and an extrusion speed of 0.5 m/min.

(5) The above bar was subjected to an aging strengthening treatment at an aging strengthening treatment temperature of 180° C. for 96 hours, and the strength was further improved to obtain the heat-resistant and soluble alloy having a high strength in this Example.

Example 5

The heat-resistant and soluble magnesium alloy described in this Example is a material having a high-strength and a fast dissolving rate, which has an elemental composition at the following atomic percentage: Lu 3.50%, Ce 0.03%, Al 0.40%, Ca 0.40%, Cu 0.20%, Ni 0.60%, impurity elements <0.30%, and the rest is Mg.

The heat-resistant and soluble magnesium alloy described in this Example was prepared in a method same as that in Example 4.

Comparative Example 1

The comparative alloy is an as-cast AZ91D magnesium alloy, and this alloy has a chemical composition of: Mg-9.0 wt %, Al-0.80 wt %, Zn-0.3 wt %, Mn-0.025 wt % Cu. The raw material of alloy (raw material comprises: a pure magnesium ingot, a pure aluminum ingot, a pure zinc ingot, a Mg—Mn master alloy, a Mg—Cu master alloy), under protection of a mixed gas of $CO_2$ and $SF_6$ (a volume ratio of 100:1), the raw materials were melt at 720° C., maintained at the temperature for 60 min, stirred for 5 min, and refined for 20 min, after the refining the temperature is raised to 760° C., allowed to stand still for 40 min, and cast into a ingot at 700° C.

Comparative Example 2

It is similar to Example 1 except that, the magnesium alloy of this Comparative example has an elemental composition at the following atomic percentage: Ce 0.04%, Al 0.20%, Ca 0.01%, Cu 0.10%, Ni 0.05%, impurity elements <0.30%, and the rest is Mg.

The heat-resistant and soluble magnesium alloy described in this Example was prepared in a method same as that in Example 1.

Figure 3:
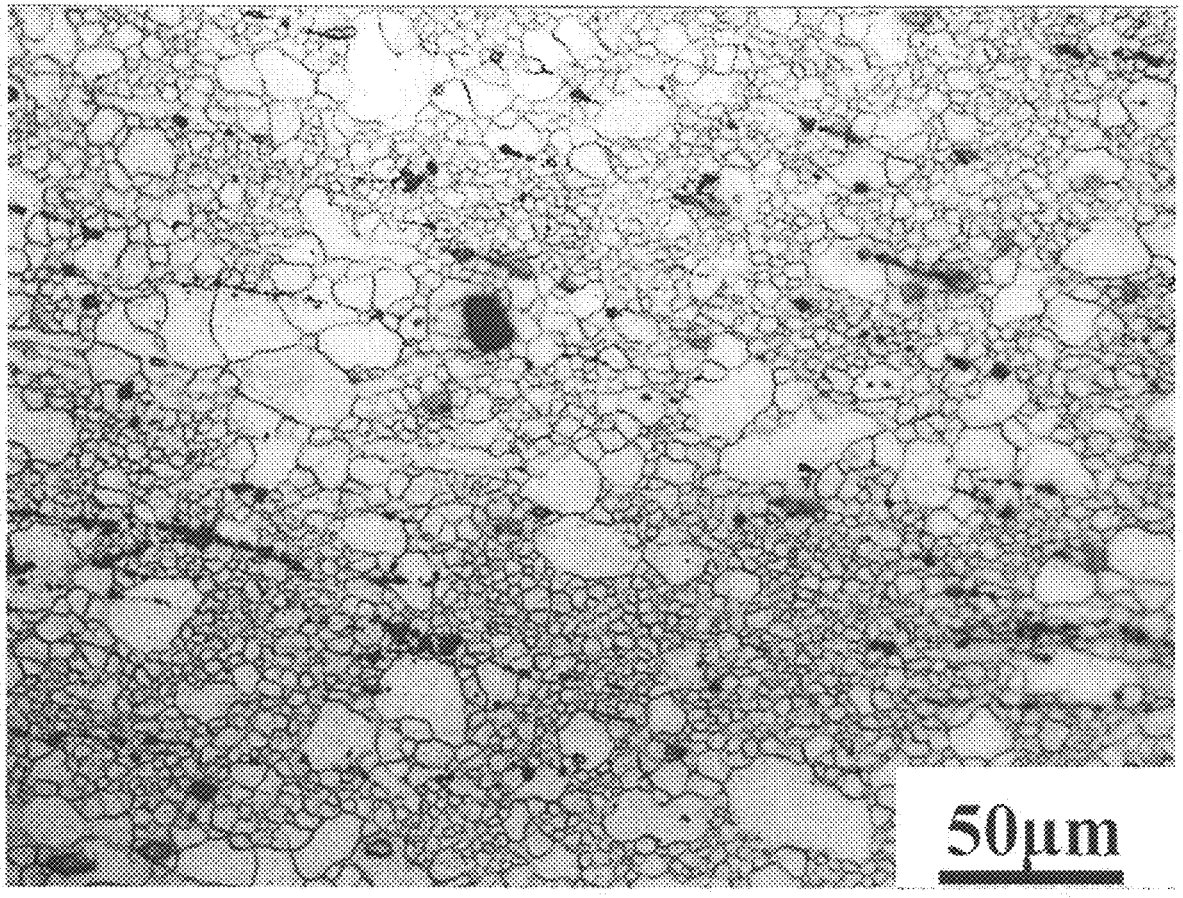
FIG. 3 is a metallographic diagram of microstructure of the magnesium alloy from Comparative example 2.

It can be seen from FIG. 3 that the microstructure of the obtained magnesium alloy has no $Lu_5Mg_{24}$ a high temperature phase therein, therefore has a high temperature performance lower than Example 1.

Comparative Example 3

It is similar to Example 1 except that the magnesium alloy of this Comparative example has an elemental composition at the following atomic percentage: Lu 0.40%, Cu 0.10%, Ni 0.05%, impurity elements <0.30%, and the rest is Mg.

The heat-resistant and soluble magnesium alloy described in this Example was prepared in a method same as that in Example 1.

Comparative Example 4

It is similar to Example 1 except that the magnesium alloy of this Comparative example has an elemental composition at the following atomic percentage: Lu 0.40%, Ce 0.04%, Al 2.20%, Ca 1.0%, Cu 0.10%, Ni 0.05%, impurity elements <0.30%, and the rest is Mg.

The heat-resistant and soluble magnesium alloy described in this Example was prepared in a method same as that in Example 1.

Comparative Example 5

It is similar to Example 3 except that the magnesium alloy of this Comparative example has an elemental composition at the following atomic percentage: Lu 9.0%, Ce 0.2%, Al 2.0%, Ca 0.40%, Cu 1.20%, Ni 1.10%, impurity elements <0.30%, and the rest is Mg.

The heat-resistant and soluble magnesium alloy described in this Example was prepared in a method same as that in Example 3.

Comparative Example 6

It is similar to Example 4 except that the magnesium alloy of this Comparative example has an elemental composition at the following atomic percentage: Lu 4.0%, Ce 0.03%, Al 2.0%, Ca 0.40%, Cu 0.20%, Ni 0.60%, impurity elements <0.30%, and the rest is Mg.

The heat-resistant and soluble magnesium alloy described in this Example was prepared in a method same as that in Example 4.

Comparative Example 7

It is similar to Example 4 except that the magnesium alloy of this Comparative example has an elemental composition at the following atomic percentage: Lu 9.0%, Ca 0.40%, Cu 0.20%, Ni 0.60%, impurity elements <0.30%, and the rest is Mg.

The heat-resistant and soluble magnesium alloy described in this Example was prepared in a method same as that in Example 4.

Comparative Example 8

The magnesium alloy in this Comparative example has an element composition same as that of Example 1, but a different preparation method. In the process of the preparation of magnesium alloy in this Comparative example, the obtained ingot was not subjected to a homogenization.

Comparative Example 9

The magnesium alloy in this Comparative example has an element composition same as that of Example 1, but a different preparation method. In the process of the preparation of magnesium alloy in this Comparative example, the above billet was extruded into a bar under the conditions of an extrusion temperature of 450° C., an extrusion ratio of 10, and an extrusion speed of 40 m/min.

Comparative Example 10

The magnesium alloy in this Comparative example has an element composition same as that of Example 4, but a different preparation method. In the process of the preparation of the magnesium alloy in this Comparative example, the obtained bar was not subjected to an aging strengthening treatment.

The heat-resisting soluble magnesium alloy of the above examples and the magnesium alloy of the comparative examples were subjected to grain size statistics, a mechanical performance test, and a dissolution performance test. The grain size statistical method was performed according to GBT6394-2002, a room temperature tensile mechanical performance test method was performed according to GB T 228.1-2010, a high temperature tensile mechanical performance test method was performed according to GB T 228.2-2015, and the dissolution performance test was performed under conditions of: a φ20 mm×20 mm sample was placed in a 3% KCl aqueous solution at a temperature of 93° C., and the weight dissolved per hour was tested. The dissolution rate was: weight of dissolution/(sample surface area ×duration). The relevant results are shown in Table 1.

TABLE 1

Grain size, room temperature mechanical performances, high temperature mechanical performances, and high temperature dissolution rate of magnesium alloy

| | | Room temperature mechanical performances | | | Mechanical performances at 150° C. | | | Yield Strength(at 150° C.)/(RT Yield Strength) × 100% | Dissolution rate in solution of 3% KCl at 93° C./ $mg \cdot cm^{-2} h^{-1}$ | Average Grain Size/μm |
|---|---|---|---|---|---|---|---|---|---|---|
| | | Tensile strength/MPa | Yield Strength/MPa | Elongation | Tensile strength/MPa | Yield Strength/MPa | Elongation | | | |
| Example | 1 | 215 | 140 | 28% | 210 | 135 | 30% | 96.4% | 46 | 8 |
| | 2 | 206 | 120 | 29% | 202 | 116 | 30% | 96.7% | 32 | 9 |
| | 3 | 425 | 401 | 16% | 422 | 402 | 17% | 100.2% | 98 | 23 |
| | 4 | 384 | 323 | 18% | 382 | 325 | 19% | 100.6% | 89 | 25 |

TABLE 1-continued

Grain size, room temperature mechanical performances, high temperature mechanical performances, and high temperature dissolution rate of magnesium alloy

| | | Room temperature mechanical performances | | | Mechanical performances at 150° C. | | | Yield Strength(at 150° C.)/(RT Yield Strength) × 100% | Dissolution rate in solution of 3% KCl at 93° C./ $mg \cdot cm^{-2} h^{-1}$ | Average Grain Size/μm |
|---|---|---|---|---|---|---|---|---|---|---|
| | | Tensile strength/MPa | Yield Strength/MPa | Elongation | Tensile strength/MPa | Yield Strength/MPa | Elongation | | | |
| | 5 | 378 | 327 | 18% | 376 | 330 | 20% | 100.9% | 85 | 32 |
| Comparative example | 1 | 260 | 193 | 6% | 220 | 162 | 7% | 83.9% | 0.2 | 42 |
| | 2 | 196 | 114 | 19% | 165 | 95 | 19% | 83.3% | 37 | 15 |
| | 3 | 206 | 116 | 18% | 172 | 93 | 19% | 80.2% | 43 | 18 |
| | 4 | 278 | 155 | 9% | 235 | 130 | 8% | 83.9% | 44 | 25 |
| | 5 | 409 | 364 | 12% | 347 | 294 | 11% | 80.8% | 92 | 34 |
| | 6 | 345 | 283 | 11% | 284 | 223 | 10% | 78.8% | 82 | 36 |
| | 7 | 357 | 294 | 10% | 296 | 227 | 9% | 77.2% | 79 | 37 |
| | 8 | 208 | 127 | 18% | 195 | 108 | 18% | 85.0% | 36 | 28 |
| | 9 | 194 | 93 | 12% | 170 | 82 | 11% | 88.2% | 34 | 54 |
| | 10 | 327 | 285 | 19% | 293 | 228 | 19% | 80.0% | 85 | 25 |

It can be seen from the results of the mechanical performance test that the heat-resistant and soluble magnesium alloy prepared by the present invention has good mechanical performances at 150° C.: its tensile yield strength at 150° C. exceeds 90% of its tensile yield strength at room temperature, and its elongation at 150° C. exceeds its elongation at room temperature. The dissolution rate in a 3% KCl solution at 93° C. is 30-100 $mg \cdot cm^{-2} h^{-1}$.

Compared with the magnesium alloy of Comparative Example 1, the heat-resistant and soluble magnesium alloy of the present invention has a dissolution rate significantly higher than that of the magnesium alloy of Comparative Example 1.

The magnesium alloys of Comparative Examples 2, 3, and 4 were prepared in same preparation method as that of Example 1, but their element contents of Lu, Ce, Al, and Ca are not within the content range of the present invention, and therefore their high-temperature mechanical performances are significantly lower than room-temperature performances.

The magnesium alloys of Comparative Examples 5, 6, and 7 were prepared in same preparation method as those of Examples 3 and 4, but their elemental contents of Ce, Al, and Ca are not within the content range of the present invention, and therefore their high-temperature mechanical performances are also significantly lower than room-temperature performances.

The magnesium alloys of Comparative Examples 8, 9, and 10 have same components as those of Examples 1 and 4, respectively, but their preparation processes are different from the requirements of the present invention, and therefore their high-temperature mechanical performances are also significantly lower than room-temperature performances.

The above descriptions are only preferred examples of the present invention, and not intended to limit the present invention. For those skilled in the art, the present invention may have various modifications and changes. Any modification, equivalent replacement, and improvement made within the spirit and principle of the present invention shall be included in the protection scope of the present invention.

The invention claimed is:

1. A heat-resistant and soluble magnesium alloy, having a composition at the following atomic percentage:

Lu 0.10% to 8.00%, Ce 0.001 to 0.05%, Al 0.10% to 0.60%, Ca 0.001% to 0.50%, Cu 0.01% to 1.00%, Ni 0.01% to 1.00%, impurity elements <0.30%, and the rest is Mg;

wherein the magnesium alloy comprises high temperature phases of $Lu_5Mg_{24}$, $Mg_2Cu$, $Mg_2Ni$, $Mg_{12}Ce$, $Al_{11}Ce_3$ and $(Mg, Al)_2Ca$, and long period stacking ordered (LPSO) phases of Mg—Lu—Al and Mg—Ce—Al.

2. The magnesium alloy according to claim 1, having a composition at the following atomic percentage:

Lu 0.10% to 4.00%, Ce 0.001 to 0.04%, Al 0.20% to 0.50%, Ca 0.10% to 0.40%, Cu 0.10% to 0.50%, Ni 0.10% to 0.50%, impurity elements <0.30%, and the rest is Mg.

3. The magnesium alloy according to claim 1, having a composition at the following atomic percentage:

Lu 0.50%, Ce 0.02%, Al 0.20%, Ca 0.10%, Cu 0.20%, Ni 0.10%, impurity elements <0.20%, and the rest is Mg.

4. The magnesium alloy according to claim 1, having a composition at the following atomic percentage:

Lu 4.0%, Ce 0.04%, Al 0.50%, Ca 0.50%, Cu 0.40%, Ni 0.20%, impurity elements <0.20%, and the rest is Mg.

5. A method for preparing the magnesium alloy according to claim 1, the method comprising:

mixing raw materials of the magnesium alloy, to obtain a mixture;

melting at 720 to 760° C. and refining the mixture to obtain a melt;

casting the melt to obtain an ingot at 680 to 700° C.;

homogenizing the ingot to obtain a billet;

plastically processing the billet to obtain a shaped part; and subjecting the shaped part to an aging strengthening treatment, thereby obtaining the magnesium alloy.

6. The method according to claim 5, wherein the raw materials comprise magnesium, aluminum, a Mg—Lu master alloy, a Mg—Ce master alloy, a Mg—Ca master alloy, a Mg—Cu master alloy and a Mg—Ni master alloy.

7. The method according to claim 5, wherein, in the refining process, a refining agent is added or an inert protective gas is introduced in a refining furnace.

8. The method according to claim 5, further comprising:

carrying out a solid solution treatment, wherein:

the solid solution treatment comprises steps that the ingot is sequentially heated, maintained at a temperature and cooled;

the ingot is heated to a temperature of 480 to 540° C. for 2 to 24 h; and an air cooling is employed.

9. The method according to claim 5, wherein the plastically processing comprises extruding, rolling or forging.

* * * * *